US005350075A

United States Patent [19]

Kahlman

[11] Patent Number: 5,350,075

[45] Date of Patent: Sep. 27, 1994

[54] ARRANGEMENT FOR CONTROLLING THE DIRECTION OF MOVEMENT OF A LOAD HOIST TROLLEY

[76] Inventor: Sture Kahlman, Låckeredsvägen 10, S-462 61 Vänersborg, Sweden

[21] Appl. No.: 781,155

[22] PCT Filed: Apr. 25, 1990

[86] PCT No.: PCT/SE90/00277

§ 371 Date: Oct. 30, 1991

§ 102(e) Date: Oct. 30, 1991

[87] PCT Pub. No.: WO90/13508

PCT Pub. Date: Nov. 15, 1990

[30] Foreign Application Priority Data

May 2, 1989 [SE] Sweden ..... 8901579-6
Jan. 2, 1990 [SE] Sweden ..... 9000003-5

[51] Int. Cl.[5] ..... B66C 13/12; H01H 9/26

[52] U.S. Cl. ..... 212/159; 212/205; 212/209; 200/5 R; 200/6 A

[58] Field of Search ..... 200/5 R, 6 A; 212/159, 212/160, 163, 164, 162, 224, 225–228, 205, 206, 209, 210, 211, 216, 217, 257; 414/281–284; 212/134, 138, 124, 133, 126; 254/270, 279, 323, 362, 380

[56] References Cited

U.S. PATENT DOCUMENTS

| | | | |
|---|---|---|---|
| 2,675,131 | 4/1954 | Osojnak | 212/124 |
| 2,940,608 | 6/1960 | Underwood et al. | 212/162 |
| 3,084,805 | 4/1963 | McKinnon | 212/159 |
| 4,291,213 | 9/1981 | Felland et al. | 200/6 A |
| 4,520,894 | 6/1985 | Hensler | 200/6 A |
| 4,723,458 | 2/1988 | Blok | 200/6 A |

FOREIGN PATENT DOCUMENTS

| | | | |
|---|---|---|---|
| 20593 | 1/1961 | Fed. Rep. of Germany | 212/216 |
| 2918010 | 11/1980 | Fed. Rep. of Germany | 212/138 |
| 604289 | 2/1960 | Italy | 212/134 |
| 174024 | 1/1961 | Sweden | 212/216 |
| 1402552 | 6/1988 | U.S.S.R. | 212/160 |
| 853395 | 11/1960 | United Kingdom | 200/6 A |

*Primary Examiner*—Michael S. Huppert
*Assistant Examiner*—R. B. Johnson
*Attorney, Agent, or Firm*—Dvorak and Traub

[57] ABSTRACT

The present invention relates to an arrangement for a load hoist comprising a load device supported by a lifting cable and a driver for driving the load device in a horizontal direction. The driver is arranged to be actuated by the movement of the lifting cable in the lateral direction in order to displace a supported load device, together with an associated load, in an appropriate direction. The displacement may be controlled by load personnel who maneuver the load device, causing the load to move in a desired direction. The invention results in simple and efficient actuation of a load hoist.

1 Claim, 8 Drawing Sheets 508
503
504
560

503
560
559

508
553
554
559
502
459
453
459
458
454
403
460
480
456

ARRANGEMENT FOR CONTROLLING THE DIRECTION OF MOVEMENT OF A LOAD HOIST TROLLEY

The present invention relates to an arrangement for a load hoist which consists of a load device capable of being supported by a lifting cable, etc., and driving means arranged for the driving of the load device in a horizontal direction.

The principal object of the present invention is, in the first place, to make available an arrangement of the kind referred to above which permits the drive for the load device to be influenced in a lateral sense through the lateral movement of the lifting cable.

Said object is achieved by means of an arrangement in accordance with the present invention, which is characterized essentially in that the driving means is so arranged as to be capable of actuation by the movement of the lifting cable in the lateral sense in order to be capable of displacing a supported load device together with the associated load in question in the appropriate direction on the intended occasions, for example when the load personnel are manoeuvring the load device manually and are causing it to move in the direction in which it is wished to move the load by means of the driving means referred to.

The invention is described below as a number of preferred embodiments, in conjunction with which reference is made to the drawings, in which FIG. 1 shows a partially sectioned view of a cable movement transmission element;

FIG. 3 shows a section through the trolley;

FIG. 3A shows the lifting cable and its patterns of movement from one side, rotated through approximately 90° from its actual direction of movement;

FIG. 4 illustrates the overhead crane trolley viewed from above, with the pattern of movement of the trolley indicated;

Figure 5:
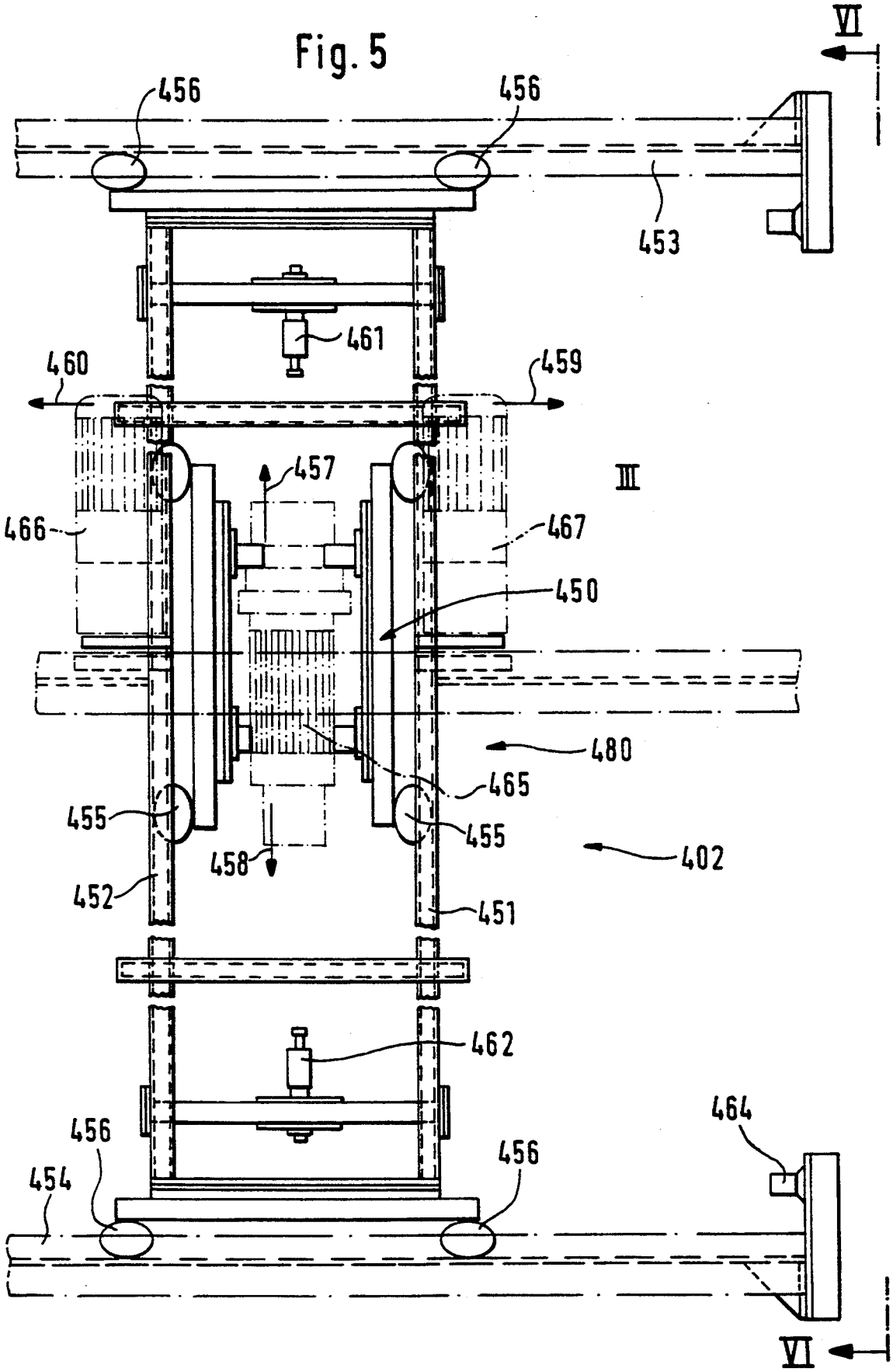
Figure 6:
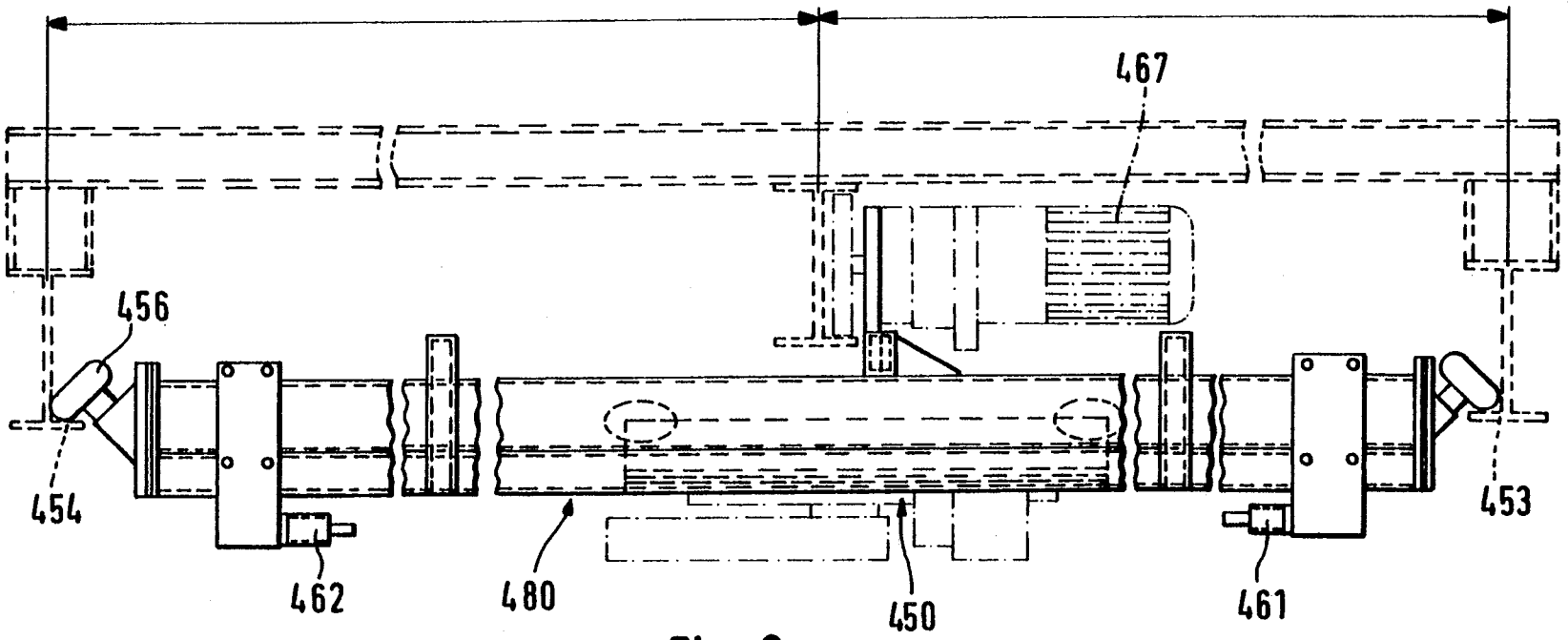
Figure 7:
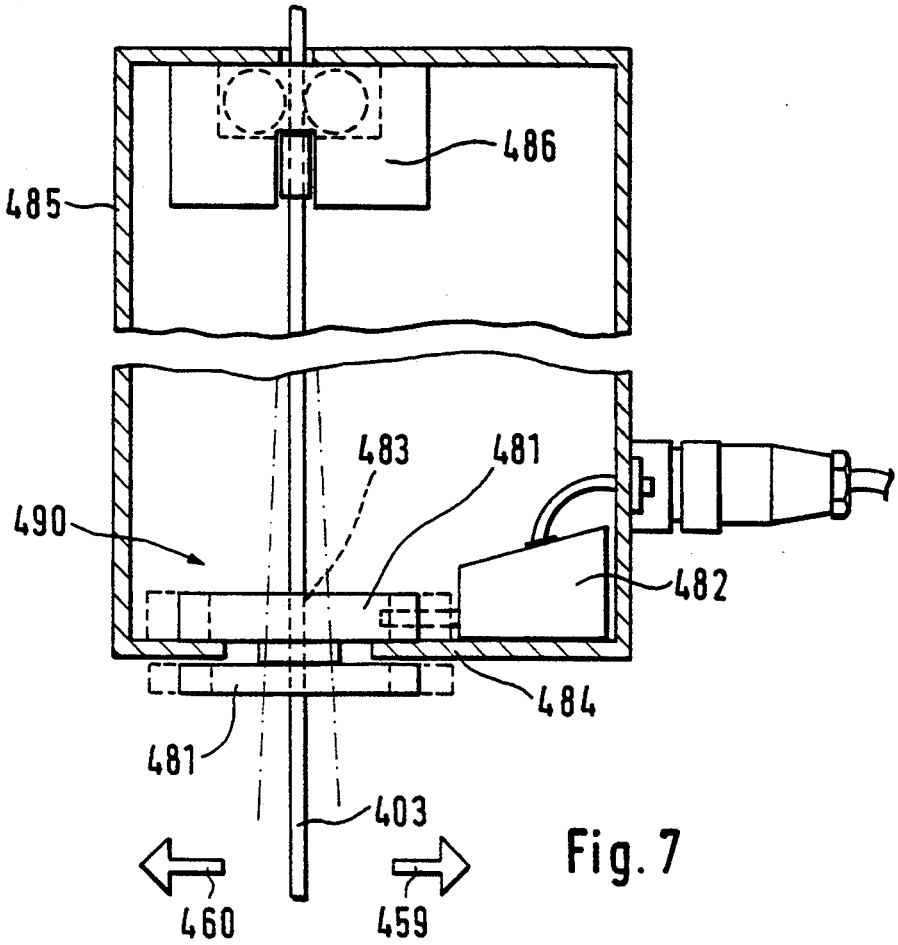
Figure 7A:
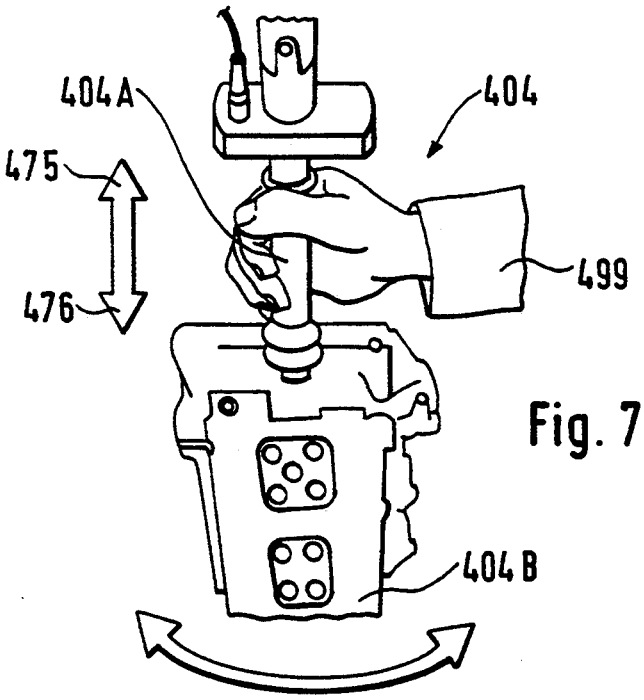
Figure 8:
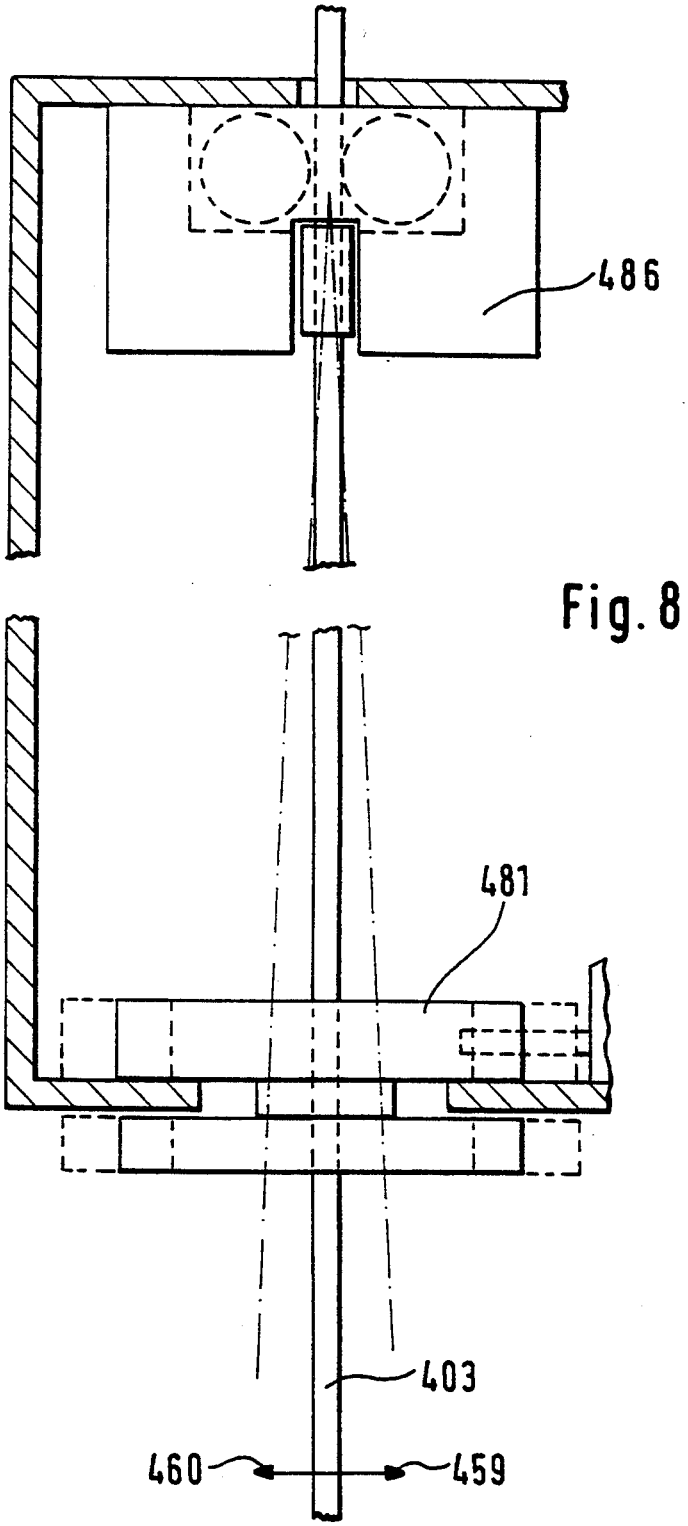
Figures 9, 10, 11:
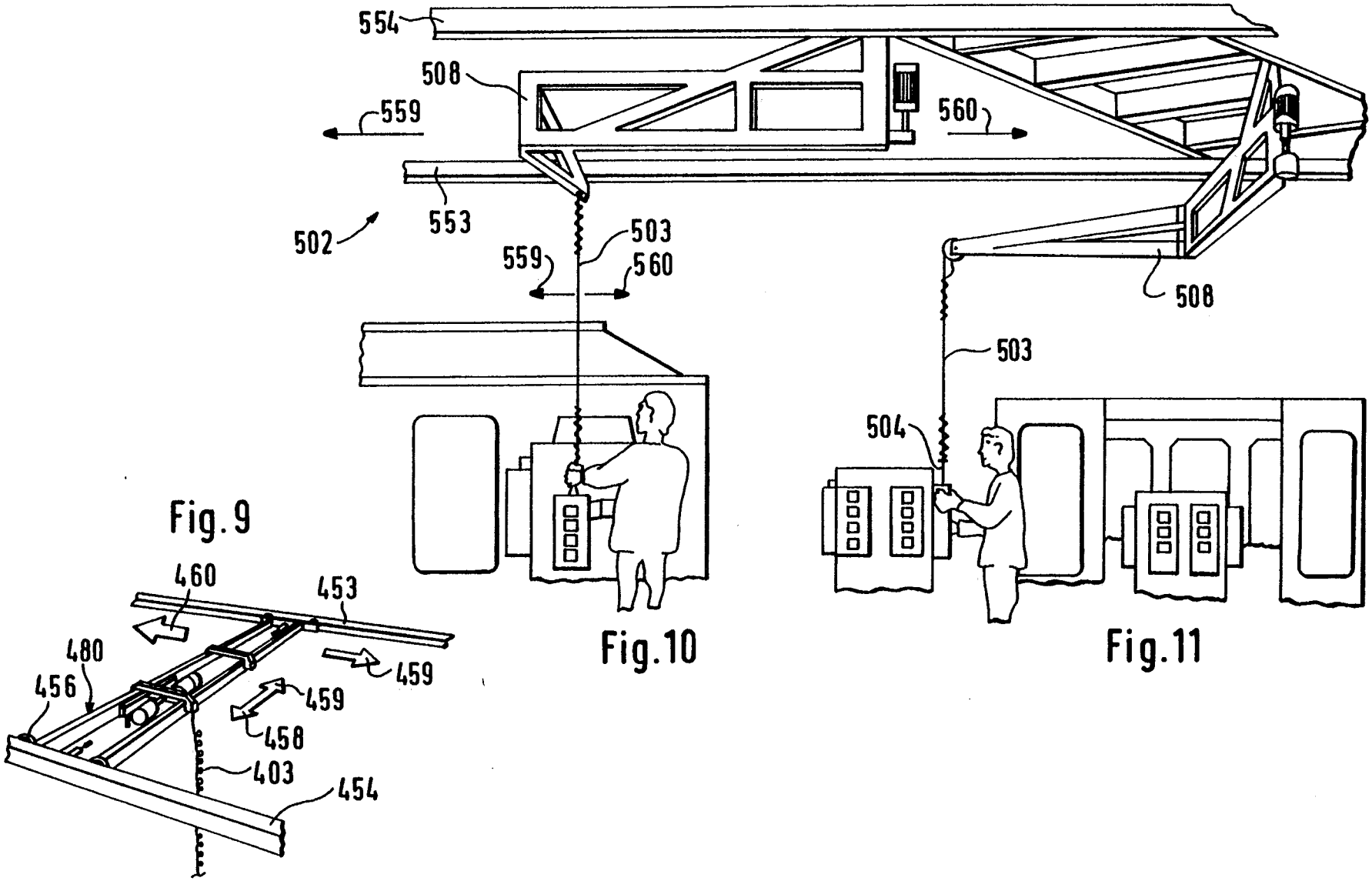

FIGS. 5–9 similarly illustrate an example of a lifting cable supported by overhead crane trolleys, where FIG. 5 shows a view from above of the travelling crane trolleys;

FIG. 6 shows a side view of the overhead crane trolleys along the arrows VI—VI in FIG. 5;

FIG. 7 shows a partially view of a cable movement transmission element applied in the example in accordance with FIGS. 5–9;

FIG. 7A shows a perspective view of a load lifting device;

FIG. 8 illustrates the cable movement transmission element in greater detail;

FIG. 9 shows the load lifting arrangement in a perspective view looking from above at an angle;

FIGS. 10–11 illustrate examples of a pivoting load hoist running along tracks;

FIG. 10 shows a load lifting arrangement in a perspective view from the side looking from below;

FIG. 11 finally shows said load lifting arrangement in a perspective view looking from the front.

A load hoist 1, preferably of a kind capable of manual operation, for example with driving means capable of being controlled electrically or by other means, such as can be appreciated from SE-B 8502716-7 (publ nr 453 589), for example, may be suitable for application to an arrangement 2 of the intended kind in accordance with the present invention, which consists of a load device 4, for example a hook, magnet, suction component, etc., capable of being supported by a lifting cable 3, together with driving means 5 arranged for driving the load device 4 in a horizontal direction 6, 7.

Suitable preferred solutions, in which the load device 4 can be applied so that it is capable of lateral displacement, are illustrated in FIG. 2, FIGS. 3–4, FIGS. 5–6 and FIGS. 10–11.

Figure 1:
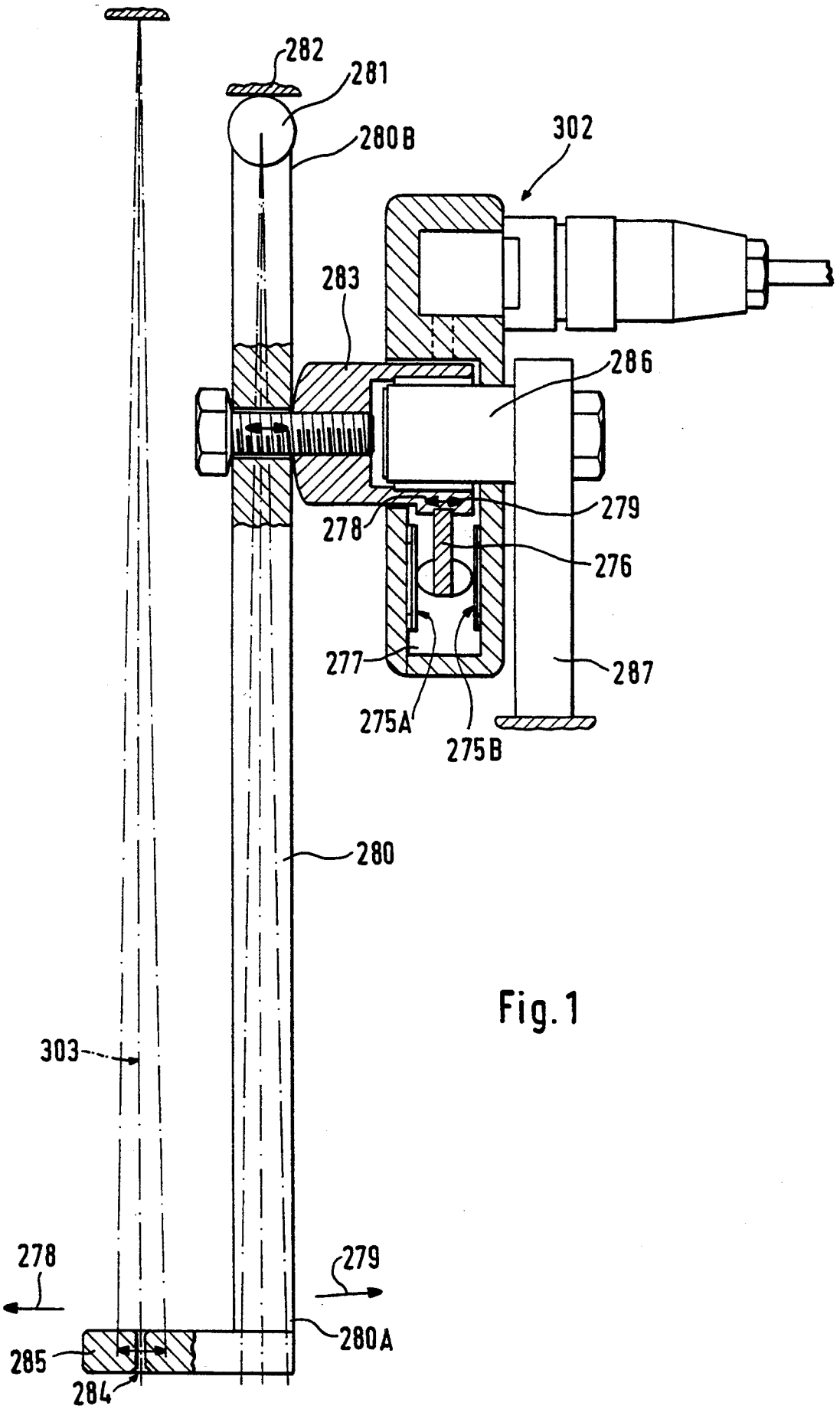
Figure 2:
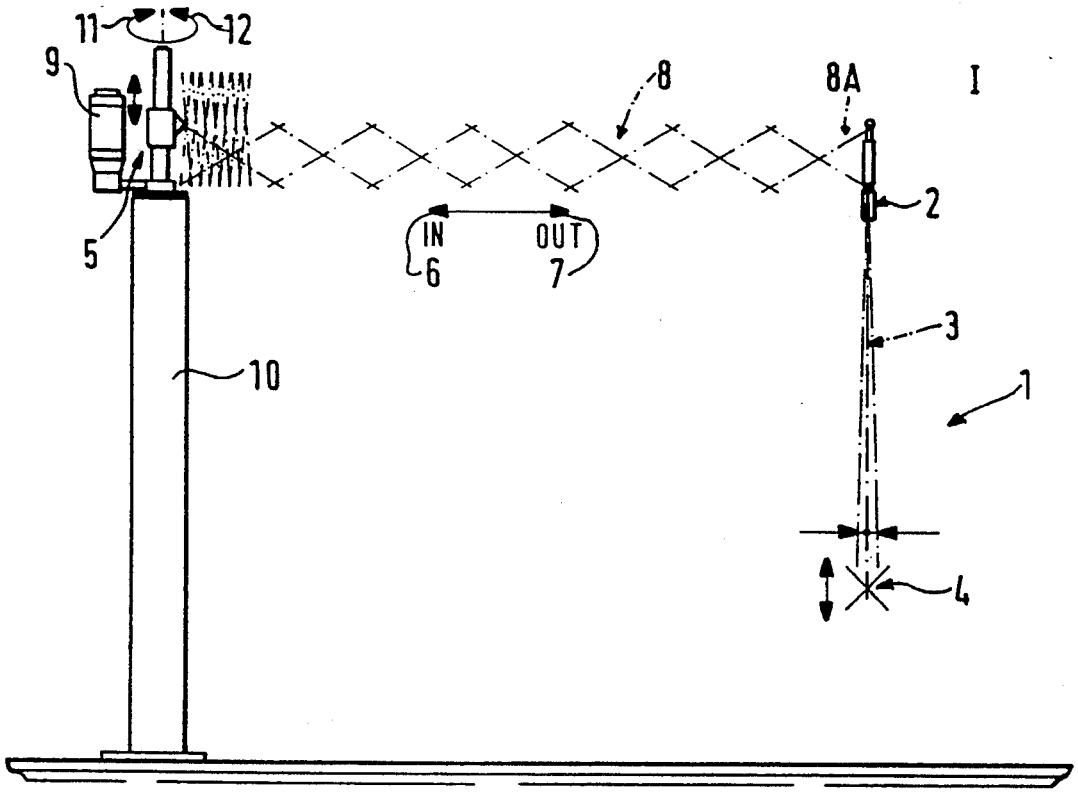
FIG. 2 illustrates diagrammatically an example of a lifting cable supported on a scissor arm.

In the case of a first illustrative embodiment I, which is illustrated in FIG. 2, a load device 4 is supported at one end 8A of a lifting and swinging arm 8, the function of which permits lateral variation 6-7 in its length, which arm consists of a so-called scissor arm in the illustrated example, although other types of arm whose length can be varied between a contracted storage position, for example, and an extended position ready for lifting can be considered, for example a telescopic arm or a so-called flexible arm, although these latter arms are not shown in FIGS. 1–2 in the drawings. The pivoting of the arm 8 can be effected by means of a separate motor, or by means of the standard motor 9 of the load hoist.

The arm 8 can also be supported by a vertical upright 10, about which the arm 8 of the upright 10 is rotated in the desired direction 11, 12.

Figure 3:
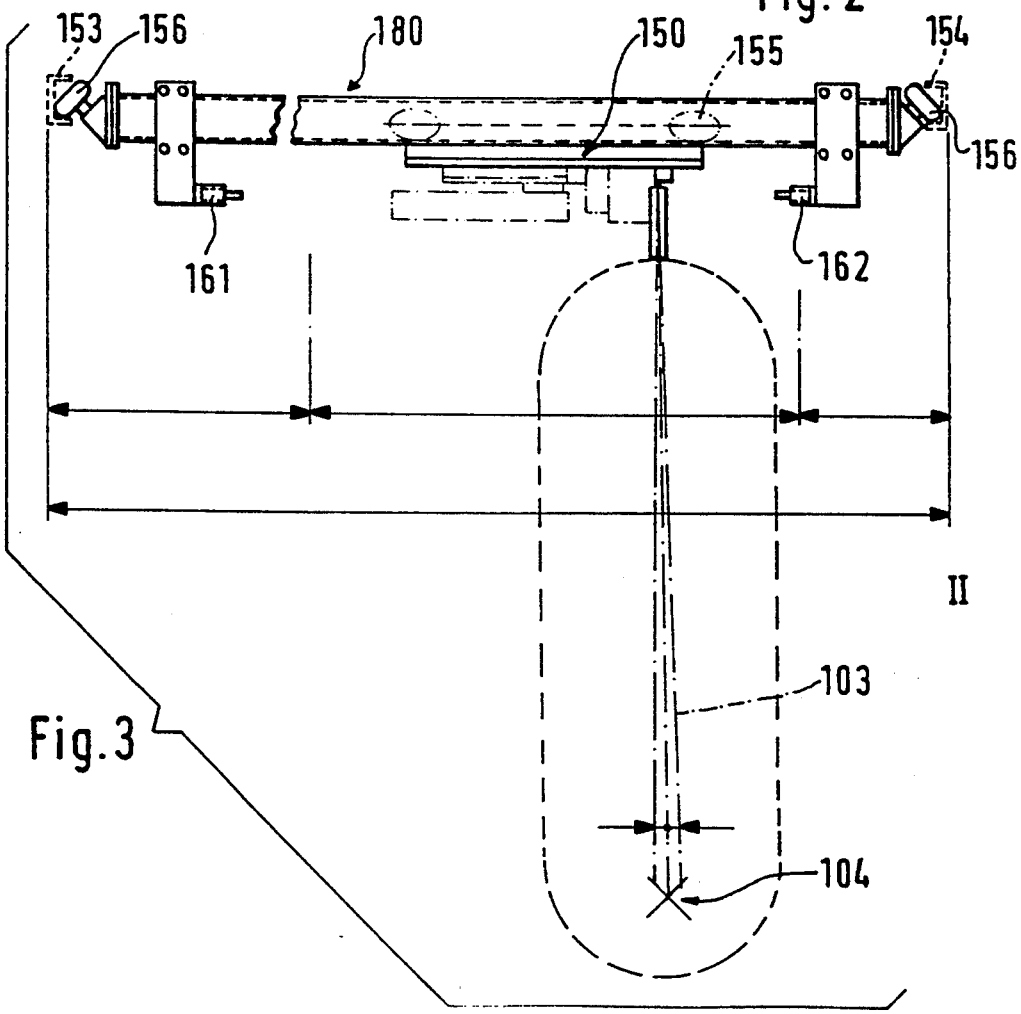
FIGS. 3–4 illustrate diagrammatically an example of a lifting cable supported on overhead crane trolleys.
Figure 4:
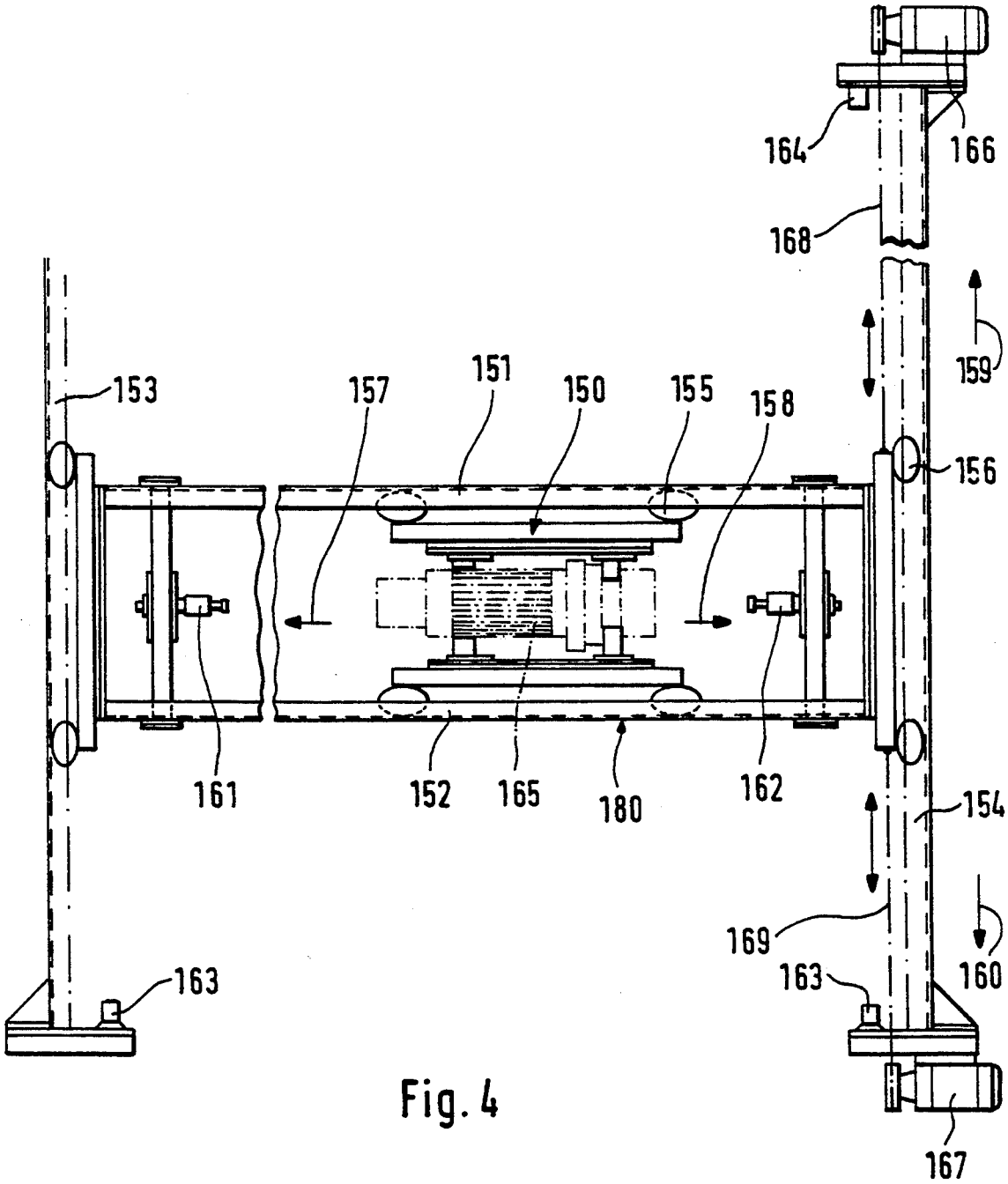

In the case of a second illustrative embodiment II, as illustrated in the drawings in FIGS. 3–4, a load device 104 is supported by a transport trolley 150, which is controlled in such a way as to run along tracks 151,152, which tracks 151, 152 can form an overhead traversing trolley 180, which can be controlled to run along further tracks 153,154 extending across said tracks 151,152, on guide wheels and runners 155,156 or other roller or slide devices, the movement of which trolleys in the horizontal direction 157,158 and 159,160 can be limited by dampers 161, 162 and 163, 164.

Driving means for driving said first trolley 150 and load device 104 can comprise a number of motors 165 supported by said trolley 150, and driving means for driving said second trolley 180 in its directions of travel 159,160 can comprise motors 166,167 operating in pairs which are connected to the trolley 180 via a cable 168,169 in such a way that it is driven in the desired direction 159, 160, depending on the direction in which the associated lifting cable 103 is caused manually to move laterally in the desired direction of travel.

In the case of a third illustrative embodiment III, as illustrated in the drawings in FIGS. 5–9, a load device 404 is supported by a transport trolley 450, which is also controlled in such a way as to run along tracks 451, 452 on wheels 455 or other similar devices, and is capable of forming an overhead traversing trolley 480. The transport trolley 450 is preferably capable of manual operation by pulling on the load device 404 in the intended direction of lateral movement 457, 458. Said overhead traversing trolley, etc., 480 can be controlled so as to run along further tracks 453, 454, which extend across said first tracks 451,452, on preferably angled driven guide wheels and runners 456 or other roller or slide devices. The movement of the trolleys 450, 480 in a horizontal direction 457, 458 and 459, 460 can be limited by dampers 461, 462 and 464.

Driving means for driving said load device 404 supported by the first trolley 480 can comprise an AC motor 465 of a previously disclosed kind, which can be fancooled and fitted with a gravity brake to act as a safety device in the event of power supply failure. The load device 404 can comprise a device of the aforementioned manually operated kind, which transmits signals, upon actuation of a control handle 404A in the desired direction of hoisting 475, 476, to the drive unit 465 for the purpose of hoisting the intended load 404B to the desired level with the hoist cable 403. Said so-called inner trolley 450 is capable of displacement manually between the dampers 461, 462 in the direction of the arrows 457, 458 along the tracks 451, 452 when the cable 403 is pulled in either of said directions 457, 458. The driving of the so-called outer travelling trolley 480 along the transverse tracks 453, 454 is effected advantageously, although not necessarily, with the help of two AC motors/solenoid motors 466, 467, which are in interaction with one another and are controlled by a signal transmitter, which are caused to move in a horizontal direction by the hoist cable 403 of the load hoist, depending on the direction 459, 460 in which the cable 403 is actuated.

The example illustrated here includes a movement transmission component 490, which comprises a position indicator control 481 interacting with the cable 403 and capable of movement laterally in relation to the cable 403. Said control 481 is connected to a potentiometer 482, or some other suitable position indicator, which is so arranged as to be actuated to a corresponding degree as the cable 403 is moved in a lateral sense 459, 460, and which is in connection with the associated drive motor 466, 467. The position indicator control 481 can be in the form of a slide, which accommodates the cable 403 in a transcurrent hole 483 or some other coupling component. The slide 481 is capable of guided displacement in the lateral sense 459–460 by an end wall 484 in a position guide housing 485, which at the top exhibits an input guide 486 for the cable 403, with which guide the cable is so arranged as to be capable of interacting.

Depending on the direction in which the cable 403 is caused to move in a horizontal sense in two mutually opposite directions, the driving of one of the motors is engaged by actuation of the cable 403 in the one direction for driving the trolley 480 in said one direction. Upon actuation of the cable 403 in the opposite direction, the other motor is so arranged as to be engaged for driving the trolley 480 in said opposite direction.

In the case of a fourth illustrative embodiment IV of the invention, as illustrated in the drawings in FIGS. 10–11, a lifting arm 508 of variable length, which supports driving means arranged for the driving in a horizontal direction of a load device 504 supported by a lifting cable 503, for the purpose of varying the length of the lift arm and/or of driving the arm 508 in the longitudinal direction 559, 560 of the tracks 453, 454 in question in a horizontal sense, is capable of actuation by the lateral movement imparted to the lifting cable in the desired direction of movement referred to.

As has already been mentioned above, said driving means 5; 165, 166, 167; 466, 467 are so arranged in accordance with the present invention as to be capable of being actuated by the lateral movement of said lifting cable 3; 103; 403 in such a way as to be capable of displacing the supported load device 4; 404 with its associated load in the corresponding direction in the intended instances, for example when the load personnel 499 are manoeuvring the load device 4, 104; 404 manually and are causing it to move in the direction in which it is wished to move the load by means of the driving means 5; 165,166,167; 466,467 referred to.

Now with reference to FIG. 1 only, which illustrates a preferred illustrative embodiment of an arrangement, it can be appreciated that a number of sensors 275A, 275B, which are situated at a mutual distance from one another, are so arranged as to be capable of actuation by a movement transmission element 276. Said element 276, which can be so arranged as to extend in between the sensors in a space 277 between same, is so arranged, by interaction with the cable 303, as to be caused by same to move in a corresponding direction 278, 279 to that in which the cable moves laterally.

Said element 276 preferably comprises a component which functions with gearing, which can consist of movably supported arm 280. The cable 303 is so arranged at the respective ends 280A, 280B of said arm as to interact with the arm 280, and the arm 280 is mounted preferably via an articulated link 281, which is supported by a suitable fixed mounting support 282. Between said ends 280A, 280B the arm 280 is connected to a movement transmission component 283.

The cable 303 preferably passes through an opening 284 in, or interacts in some other appropriate fashion with a connecting piece 285 extending sideways from the arm 280.

Furthermore, the movement transmission component 283 can comprise a piston capable of moving laterally 278, 279 in relation to the cable 303, which piston can be movably supported on a bearing shaft 286 extending in the direction of movement and interacting with the piston 283. Said bearing shaft 286 is held immovably by a fixed support 287, which can be supported by an arm 8, trolley 150, 180, etc.

An actuating finger 276 connected to said piston 283 is so arranged as to function as a movement transmission element in order distinctly to transmit lateral movements from the cable 303 to the sensor 275A, 275B concerned.

Thus, with reference to FIGS. 3–4, the system is so arranged as to be capable of sensing movement in a horizontal direction in a lifting cable 103, which is arranged on a transport trolley 150 and 180, which is guided along tracks 151–152 and 153–154, and which carries hoist machinery 165 for said lifting cable. Information from said cable sensing is so arranged as to be capable of being transmitted to the drive motor of the intended trolley and/or for sensing purposes, for example through the presence of a potentiometer.

Also, a signal transmitter 275A, 275B and/or a sensor capable of being actuated by the cable 103 is so arranged as to transmit lateral movement in the cable to a motor 165; 166, 167 capable of driving a trolley 150; 180, and preferably to a travelling motor 166, 167 connected to the crab travel cable of the trolley 180 and acting in the desired direction of movement of the cable.

With reference to FIG. 2, the ability to vary the length of the arm is so arranged as to be achieved by means of a signal-controlled arm driving motor 5.

An actuating component provided for the lateral movement of the cable is thus so arranged as to act along the longitudinal extent of the arm or along the final intended extent of the arm from the upright.

A simple and efficiently functioning arrangement of this kind 2; 102; 302; 402; 502 is thus capable of being obtained through the present invention, the function and the nature of which should have been appreciated on the basis of 6he foregoing and with reference to the drawings.

The invention is not, however, restricted to the embodiments described above and illustrated in the drawings, but can be freely modified within the scope of the Patent claims without departing from the idea of invention. It is thus possible to cause the two trolleys to move simultaneously when a lifting cable of the kind in question is moved in a direction at an angle to the perpendicular x and y co-ordinates. The sensors, etc., contained in the arrangement can be of a previously disclosed kind, for example of the kind referred to in the aforementioned publication.

I claim:

1. A load hoist arrangement comprising a manually controllable load device supported by a lifting cable, driving means for driving said load device in a horizontal direction, a movement transmission element, said movement transmission element having a slidable position indicator control which is laterally slidable in reaction to lateral movement of the lifting cable, a potentiometer which is actuated by said slidable position indicator control, a transport trolley mounted on said driving means and having hoist machinery connected with said lifting cable, said transport trolley movable in at least two opposite directions, and at least two drive motors for driving said trolley in said two opposite directions, means connecting said drive motors with said position indicator control, whereby manual lateral movement in one direction of said lifting cable by an operator actuates said movement transmission element such that said position indicator control transmits a signal to one of said drive motors, causing said motor to drive said trolley in the same direction as the manual lateral movement of said lifting cable, and whereby manual lateral movement of said lifting cable in the opposite direction likewise causes trolley movement in the opposite direction.

* * * * *